United States Patent [19]

Pater

[11] Patent Number: 4,570,647

[45] Date of Patent: Feb. 18, 1986

[54] CIGARETTE EXTINGUISHER FOR AUTOMOBILE

[76] Inventor: Michel Pater, 475 Villeneuve O., Montreal, Canada, H2V 2R8

[21] Appl. No.: 586,328

[22] Filed: Mar. 5, 1984

[51] Int. Cl.[4] ..... A24F 19/14

[52] U.S. Cl. ..... 131/237; 131/235.1

[58] Field of Search ..... 131/231, 235 R, 235 ST, 131/237, 256; 296/37.1, 37.8, 37.9, 37.11

[56] References Cited

U.S. PATENT DOCUMENTS

| | | | |
|---|---|---|---|
| 2,156,906 | 5/1939 | Vajda | 131/235 R |
| 2,820,464 | 1/1958 | Sweet | 131/237 |
| 2,854,011 | 9/1958 | McComb | 131/237 |
| 3,477,444 | 11/1969 | Adams et al. | 131/237 |
| 3,486,509 | 12/1969 | Menold | 131/235 R |
| 3,586,008 | 6/1971 | Fredette | 131/235.1 |
| 4,497,329 | 2/1985 | O'Dell | 131/237 |

FOREIGN PATENT DOCUMENTS

| | | | |
|---|---|---|---|
| 3004002 | 8/1981 | Fed. Rep. of Germany | 296/37.9 |
| 2470549 | 6/1981 | France | 131/237 |

*Primary Examiner*—V. Millin
*Assistant Examiner*—H. Macey

[57] ABSTRACT

A cigarette extinguisher designed to be secured more specifically over an automobile ash-tray. A cigarette-receiving tube is pivotally supported between the upright legs of a U-shape support for movement between a cigarette-extinguishing position and an extinguished cigarette-discharging position. The discharge end of the tube is bevelled and lies flat against the bight portion of the support in cigarette-extinguishing position, so as to close the tube. Once the cigarette is snuffed out, the tube is simply pivoted to a more inclined position, so that the extinguished cigarette will clear the bight portion and drop into the underlying ash-tray. A securing device is designed to fix the extinguisher in a plurality of positions to an ash-tray of the automobile type, depending on the shape of the ash-tray.

3 Claims, 4 Drawing Figures

CIGARETTE EXTINGUISHER FOR AUTOMOBILE

FIELD OF THE INVENTION

This invention relates to a cigarette extinguisher more specifically designed to be fixed to an automobile ashtray.

BACKGROUND OF THE INVENTION

Prior art in the field of cigarette extinguishers shows several of the type which can discharge into an ash-tray or the like the extinguished cigarette butt. Such known extinguishers include a movable part and a fixed part having surfaces in sliding contact, which surfaces are liable to become clogged up with dirt and the like, thereby preventing further operation of the extinguisher. Also, known extinguishers generally require substantial headroom for the installation onto an automobile ash-tray and, therefore, are not suitable for ash-trays of the shallow type as now commonly found in recent automobile models.

OBJECTS OF THE INVENTION

It is consequently the main object of the present invention to provide a cigarette extinguisher which is of simple and inexpensive construction and which will keep in operating condition for a long time, even with a minimum of upkeep.

Another object of the present invention is to provide a cigarette extinguisher which can discharge the extinguished cigarette into an ash-tray by simple pivotal movement of the cigarette-receiving tube.

Another object of the invention is to provide means capable of securing the cigarette extinguisher to different parts of an automobile ash-tray, so that the extinguisher can be fixed to various known types of such ash-trays.

SUMMARY OF THE INVENTION

The cigarette extinguisher of the invention comprises a U-shape support between the side legs of which is pivotally mounted a cigarette-receiving tube. This tube has a bevelled discharge end which makes a flat and substanairtight contact with the bight portion of the support when the tube is in cigarette-extinguishing position. The tube, in this position, is inclined with respect to said bight portion to permit its pivotal movement. When the tube is pivoted to cigarette-discharging position, it clears the transverse edge of the bight portion to permit discharge of the extinguished cigarette into an underlying ash-tray. Preferably, spring means are provided to resiliently maintain the tube in cigarette-extinguishing position.

Preferably, the various parts of the extinguisher are easily dismountable and assembled.

Preferably also, a stop means limits the pivotal opening movement of the tube to a cigarette-discharging position in which the tube is still downwardly inclined with respect to the horizontal to permit automatic discharge of the extinguished cigarette by gravity.

Preferably, means are also provided including a spring clip which can be attached to various sides of the U-shape support to fix the extinguisher to automobile ash-trays of various makes.

DETAILED DESCRIPTION OF THE INVENTION

Figure 1:
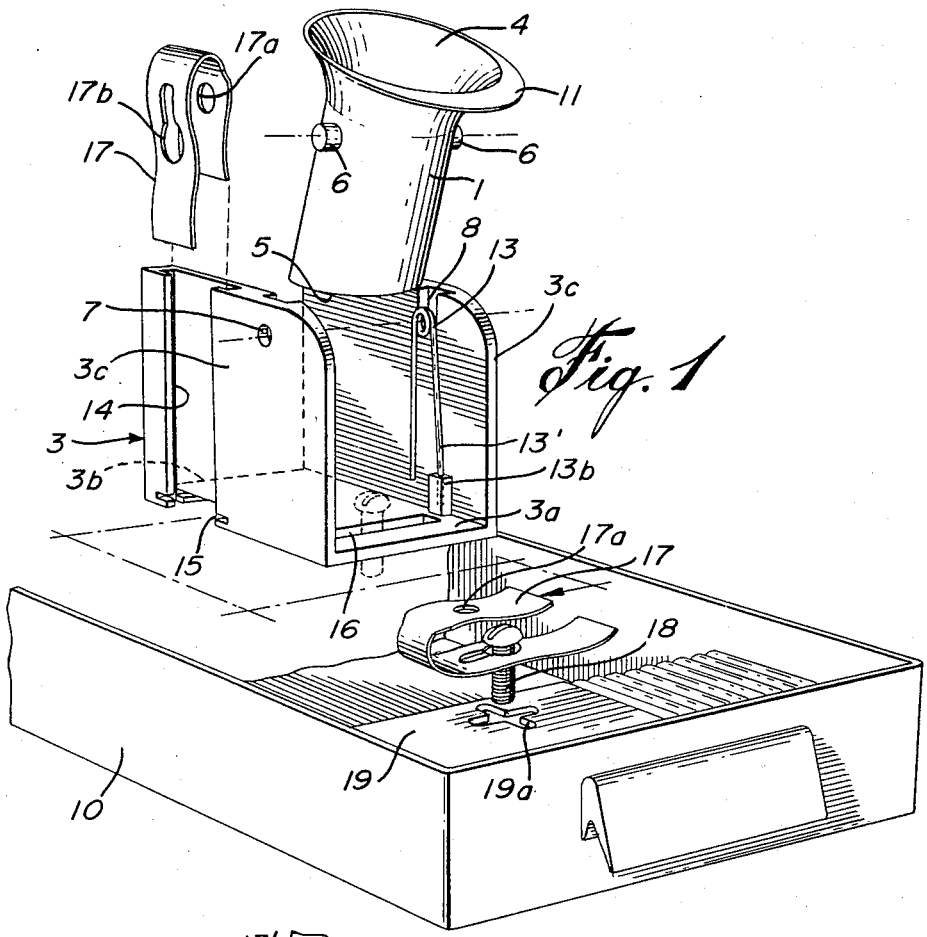
FIG. 1 is an exploded perspective view of the cigarette extinguisher and also of an underlying automobile ash-tray to which the extinguisher is adapted to be secured.

The cigarette extinguisher comprises a cigarette-receiving cylindrical tube 1 open at both ends and defining a cylindrical passage 2 of a diameter slightly larger than that of a conventional cigarette. This tube 1 is located between the two legs 3*c* of a U-shape support 3, the bight portion 3*a* of which defines a free edge 3*b*. Tube 1 is open ended and has an inlet end 4 which has a bell-mouth shape flaring radially outwardly, so as to extend laterally outwardly from the top edges of the legs 3*c*. The discharge end of tube 1 is indicated at 5 and is bevelled, so as to contact with the top surface of the bight portion 3*a* over its entire perimeter to form a substantially airtight closure when the tube 1 is in cigarette-extinguishing position.

Tube 1 is pivotally supported on the support legs 3*c* by means of a pair of diametrically-opposed pins 6 fixed to the outside of tube 1 intermediate the ends thereof and engageable with holes 7 made in the top portion of legs 3*c*. These legs are slightly resilient, so that they can be spread apart to permit insertion and removal of the pins into and from holes 7. To further facilitate pin insertion and removal, the inside faces of the legs 3*c* are provided with slanted grooves 8 opening at the outer edge of the legs 3*c* and at the holes 7.

Figure 2:
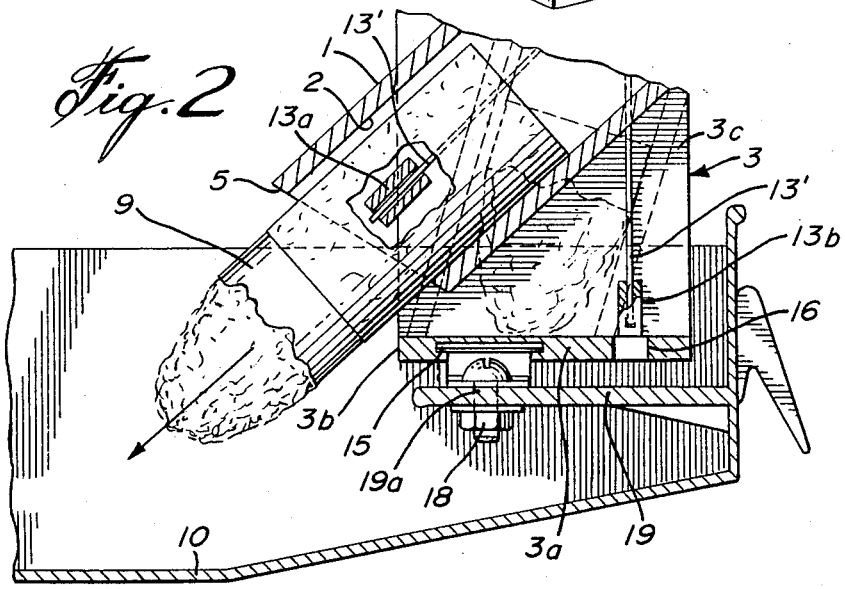
FIG. 2 is a vertical section of the cigarette extinguisher and also showing the automobile ash-tray in partial longitudinal section.

The distance between the pivotal axis defined by pins 6 and the discharge end 5 of tube 1, as measured along the longitudinal axis of tube 1, is greater than the distance between the pivotal axis and the bight portion 3*a*, as clearly shown in FIG. 2, such that, when the tube 1 is in cigarette-extinguishing position, as shown in dotted line in FIG. 2, the tube is inclined with respect to the bight portion 3*a* at an angle of less than 90 degrees. In this position, it is noted that the edge portion of the tube discharge end furthest from the pivotal axis is closely adjacent to the transverse free edge 3*b* of the bight portion 3*a*. Due to this arrangement, pivotal opening movement of the tube is permitted, so that when it attains its cigarette-discharging position, as shown in full line in FIG. 2, the tube passage 2 clears the free edge 3*b* and the extinguished cigarette butt 9 can fall under gravity into the underlying ash-tray.

Opening pivotal movement of the tube 1 is facilitated by the provision of a tab 11 formed integral with the lower edge portion of the inlet end 4, as indicated at 11, and adapted to receive pressure from a finger.

Figure 4:
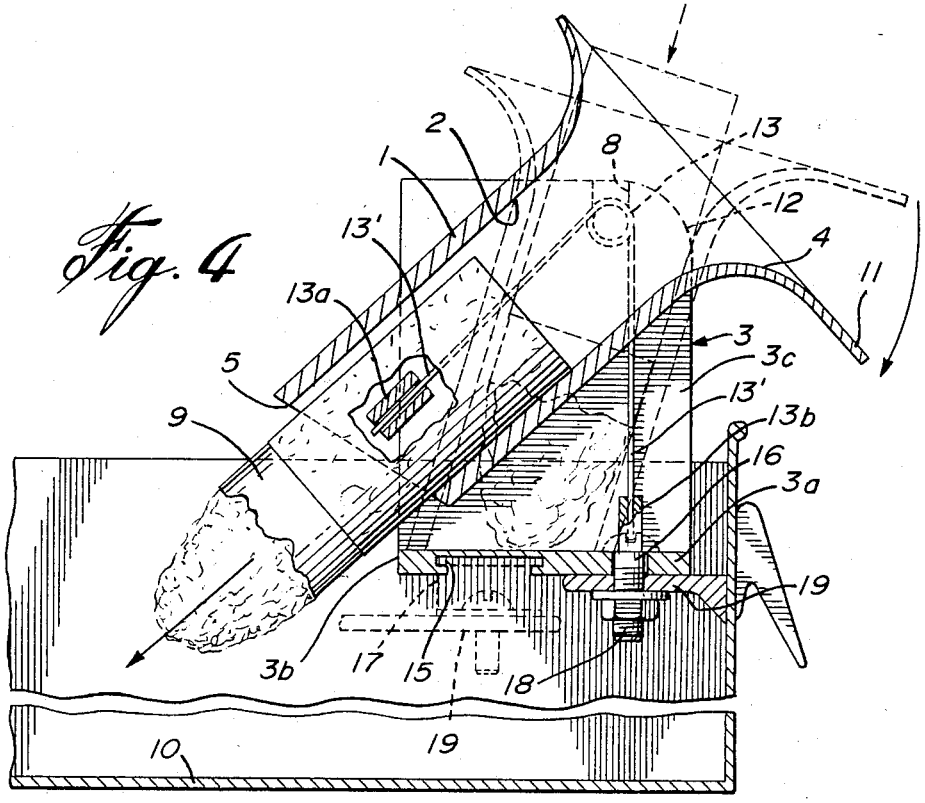
FIG. 4 is a longitudinal section taken along line 4—4 of FIG. 3 of the ash-tray with the cigarette extinguisher installed therein.
Figure 3:
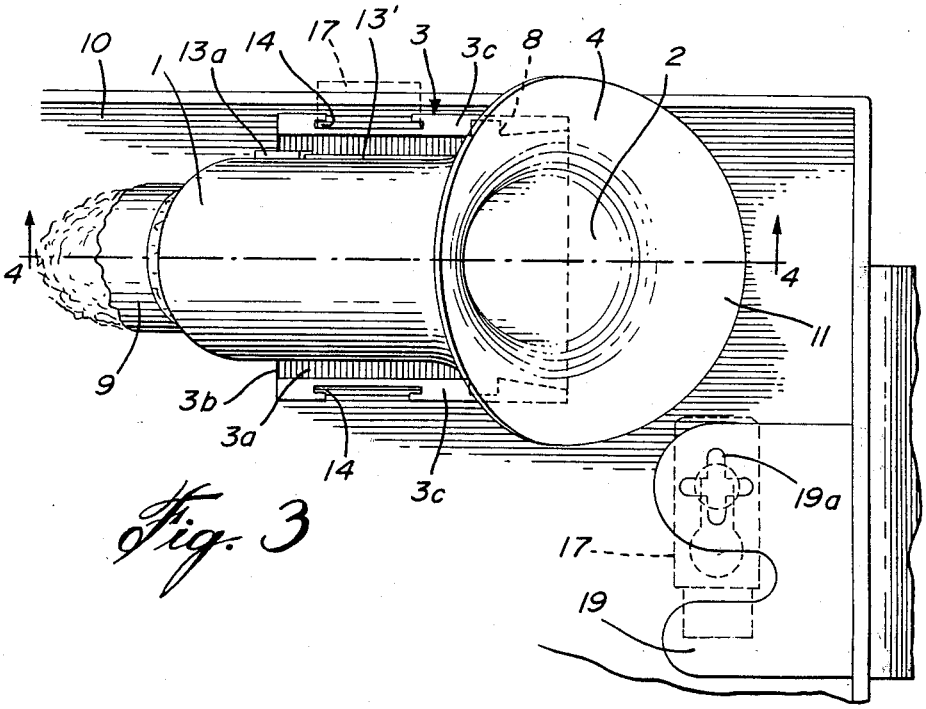
FIG. 3 is a top plan view of the cigarette extinguisher as installed on the ash-tray.

Biasing means are provided to return the tube 1 into its cigarette-extinguishing position. These biasing means consist of a coil spring 13 freely surrounding one of the pivot pins and having straight leg portions 13' engaged between ribs 13*a* and 13*b* protruding from the sides of the tube 1 and the inside face of the corresponding leg 3*c*, respectively, adjacent the bottom portion of tube 1 and leg 3*c*. The flared inlet end 4 of tube 1, which protrudes outwardly from the legs 3*c*, makes a point contact with the top edge of said legs 3 in the cigarette-discharging position of tube 1, as indicated at 12 in FIG. 4, thereby constituting stop means further limiting the opening movement of tube 1.

Dirt or other debris which may become deposited on the pins 6 or within holes 7, will not prevent pivotal movement of tube 1, even after a long period of use.

Simple means are provided to removably secure the support 3 to various positions of a standard automobile ash-tray, shown at 10 in the drawings, and usually provided with a cigarette-extinguishing tongue 19 which is often perforated. These securing means comprise two leg grooves 14, each made in the outer face of the legs 3*c* and opening at the top and bottom of said legs, and a third groove 15, namely a bight groove, which extends transversely of the support at the underface of the bight portion 3*a*. These grooves are of T-shape cross-section and designed to have a friction fit with one of the legs of a U-shape spring clip 17 made of a wavy flat spring stock. The legs of said spring clip 17 have a circular hole 17*a* and a registering bayonnet-shape hole 17*b*, respectively. The shorter leg of the spring clip 17 is designed to be frictionally inserted into anyone of the leg grooves 14 with the external and longer leg of the spring clip 17 engaging the outside of a wall of the ash-tray 10. The same spring clip, when inserted within the bight groove 15, serves to attach the support directly to the tongue 19 of the ash-tray by means of a bolt and nut 18 which extends through conventional hole 19*a* of tongue 19. Depending on the position of the tongue 19, the support 3 can be attached directly to said tongue by means of the said bolt and nut 18 with the bolt extending through a slot 16 made in the bight portion 3*a*.

I claim:

1. A cigarette extinguisher and ash-tray combination for use in an automobile, comprising:

a support, including a bight portion and a pair of upright spaced legs;

an ash-tray defining a bottom and side walls;

means connecting said support to said ash-tray with said bight portion spaced above the bottom of said ash-tray;

an open-ended cylindrical snuffer tube having a top inlet end, for insertion of a lighted cigarette, and a bottom bevelled outlet end, for discharge of said cigarette into said ash-tray; said tube having a pair of diametricallyopposite pivot pins protruding outwardly therefrom intermediate the ends thereof, said legs having registering holes receiving said pivot pins for pivotal action of the tube thereabout in between as inclined cigarette extinguishing position in which said bottom bevelled end abuts said bight portion and a more-inclined cigarette-discharging position in which said bottom bevelled end clears said bight portion and a coil spring surrounding one of said pivot pins between said tube and one of said legs and having straight end portions removably attached to said tube and to said one leg respectively, and biased to press the bottom outlet of said snuffer tube against said bight portion in said cigarette-extinguishing position, and prevent play of said snuffer tube relative to said support despite the vibrations imparted to said extinguisher during movement of the automobile carrying said ash-tray.

2. The combination as defined in claim 1, whereby said snuffer tube inlet end is flared and protrudes outwardly from said support legs and makes a point contact with the top edge of said legs in the cigarette-discharging position, to thereby constitute stop means limiting further pivotal movement of the snuffer.

3. The combination as defined in either of claims 1 or 2, whereby said snuffer tube and said one leg each further including a pair of outer ribs between which one of said straight end portions is removably inserted and retained.

* * * * *